US007216903B1

(12) United States Patent
Kent et al.

(10) Patent No.: US 7,216,903 B1
(45) Date of Patent: May 15, 2007

(54) DEADBOLT SECURITY DEVICE

(76) Inventors: Ronald W. Kent, 5129 Gracewood La., St. Augustine, FL (US) 32092; Joseph A. Lubrant, Jr., 1332 Pine Bloom Ct., Jacksonville, FL (US) 32259

( * ) Notice: Subject to any disclaimer, the term of this patent is extended or adjusted under 35 U.S.C. 154(b) by 0 days.

(21) Appl. No.: 11/580,764

(22) Filed: Oct. 13, 2006

(51) Int. Cl.
*E05B 13/00* (2006.01)

(52) U.S. Cl. ..... 292/288; 70/416

(58) Field of Classification Search ..... 292/288; 70/429–430
See application file for complete search history.

(56) References Cited

U.S. PATENT DOCUMENTS

| | | | | |
|---|---|---|---|---|
| 3,933,014 | A * | 1/1976 | Moses | 70/416 |
| 4,279,137 | A * | 7/1981 | Cook | 70/416 |
| 4,715,200 | A | 12/1987 | Katsaros | |
| 4,947,663 | A | 8/1990 | Yeager | |
| 5,000,498 | A | 3/1991 | Upchurch | |
| 5,052,202 | A | 10/1991 | Murphy | |
| 5,067,334 | A | 11/1991 | Sorkilmo | |
| 5,193,373 | A | 3/1993 | Hunt | |
| D334,703 | S * | 4/1993 | Murphy | D8/331 |
| 5,313,812 | A | 5/1994 | Eklund et al. | |
| 5,515,704 | A | 5/1996 | Van Nguyen | |
| 5,754,107 | A | 5/1998 | Ferrantelli | |
| D397,025 | S * | 8/1998 | Kosi | D8/343 |
| 6,301,941 | B1 | 10/2001 | Nicholsfigueiredo | |
| 6,655,178 | B1 | 12/2003 | Lingbeck | |
| 7,144,052 | B1 | 12/2006 | Kent et al. | |
| 2005/0193787 | A1 * | 9/2005 | Davis | 70/416 |

* cited by examiner

*Primary Examiner*—Brian E. Glessner
*Assistant Examiner*—K R Gluchowski
(74) *Attorney, Agent, or Firm*—Lawrence J. Gibney, Jr.

(57) ABSTRACT

This is a device, which will be inserted over the doorknob and behind a deadbolt. It will prevent a deadbolt from turning in the event that someone with a key tries to enter the home or business while the space as being occupied. This device is not meant to function as a security device but only to insure greater privacy for a homeowner or business owner.

2 Claims, 4 Drawing Sheets

DEADBOLT SECURITY DEVICE

CROSS REFERENCES TO RELATED APPLICATIONS

This is an improvement of the application with Ser. No. 11/003,550 with a filing date of Dec. 3, 2004.

BACKGROUND OF THE INVENTION

A. Field of the Invention

It is sometimes important, particularly for apartment dwellers, but also homeowners to prevent entry of an individual into the home. Most doors leading into a house or apartment have both the standard door lock as well as a deadbolt. This device would be inserted in the space between the deadbolt lock and the deadbolt plate from the inside of the door. A series of indentations or channels encircle the deadbolt handle. When the key is inserted into the deadbolt and turned this device would prevent the deadbolt from turning and unlocking the door.

B. Prior Art

There are many other examples of prior art, which are related to deadbolt security systems. Representative examples of these include Murphy, U.S. Pat. No. 5,052,202, Katsaros U.S. Pat. No. 4,715,200, and Hunt U.S. Pat. No. 5,193,373.

The closest relevant prior art to the current idea is Murphy. In the Murphy application the top surface of the device fits over the deadbolt lock. A securement device is employed to prevent the deadbolt lock from moving in the event that a key is turned. Additionally, a set of forks surrounds the door handle. In Murphy the grooves on the top portion that surround the deadbolt are limited to two possible positions—vertical and horizontal—and are flush with the side of the deadbolt lock.

Unlike Murphy, the current device does not surround but is indented so that the device will be inserted behind the deadbolt. A series of indentations or channels, which are provided at different angles prevents the deadbolt from turning if entry is attempted. This series of indentations or channels are necessary in the event that the deadbolt is locked in other than a vertical or horizontal position. This device completely surrounds the door handle to insure that the device remains on the door when not in use. This set of channels into which the deadbolt handle will be inserted is created by a series of raised surface on the top portion of the device. A retaining ring is placed along the perimeter of the raised surfaces to better insure that the device remains in place during normal use.

Unlike the other referenced prior art this device does not require modification of the existing deadbolt door lock and has no moving parts.

BRIEF SUMMARY OF THE INVENTION

This is a device, which will prevent an unnecessary or unwanted intruder from entering a home, business or apartment when it is occupied. Most doors use a deadbolt locking system and this device prevents the deadbolt from turning when the key is being used to attempt to unlock the deadbolt.

This device is particularly helpful in situations such as apartment complexes when various individuals, i.e. maintenance personnel, apartment managers etc. must access the apartment for needed repairs. This could also be used by women or the elderly as an added security measure in their homes or apartments.

Most standard apartments do not have a lock on the door knob and are only equipped with a deadbolt to secure the door. The door allows ingress and egress to the home, business or apartment while the deadbolt is the only means of providing securement of the door and a deadbolt provides more security for the door to the doorjamb. The deadbolt is comprised of the lock itself, an entry point for the key, plates for the interior and exterior of the door and a deadbolt handle, which is located in the interior of the building. The deadbolt handle moves when the door is locked and unlocked. The deadbolt handle allows the homeowner to securely lock the door after entry into the apartment or home.

This device will be inserted between the inside deadbolt plate surface and the surface of the deadbolt handle, which is closest to the door. A series of indentations or channels in the device, which are angled would surround the deadbolt when the device is installed.

The device is comprised of a top portion and a bottom portion that are connected together by a pair of parallel connecting members. The device is designed to slip over the door handle when not in use.

A plurality of raised surfaces is positioned along the top portion of the device to form a series of channels or grooves into which the deadbolt handle will be inserted. The raised surfaces are of predetermined dimensions to allow the deadbolt handle to remain in the channel or groove during normal operation. A retaining ring on the top surface of the perimeter of the raised surfaces is provided for additional security.

The top portion is connected to the bottom portion of the device with a pair of parallel connecting members. A reinforcing member connects the two connecting members near the bottom of the top portion for additional rigidity and support.

In operation, as someone begins to turn the deadbolt from the exterior with a key the indentation or channel would prevent the deadbolt from turning the necessary number of degrees to allow the door to be unlocked. The device would use the door handle to further insure that the device would not slip off the deadbolt or door handle and prevents the deadbolt from turning.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENTS

Figure 1:
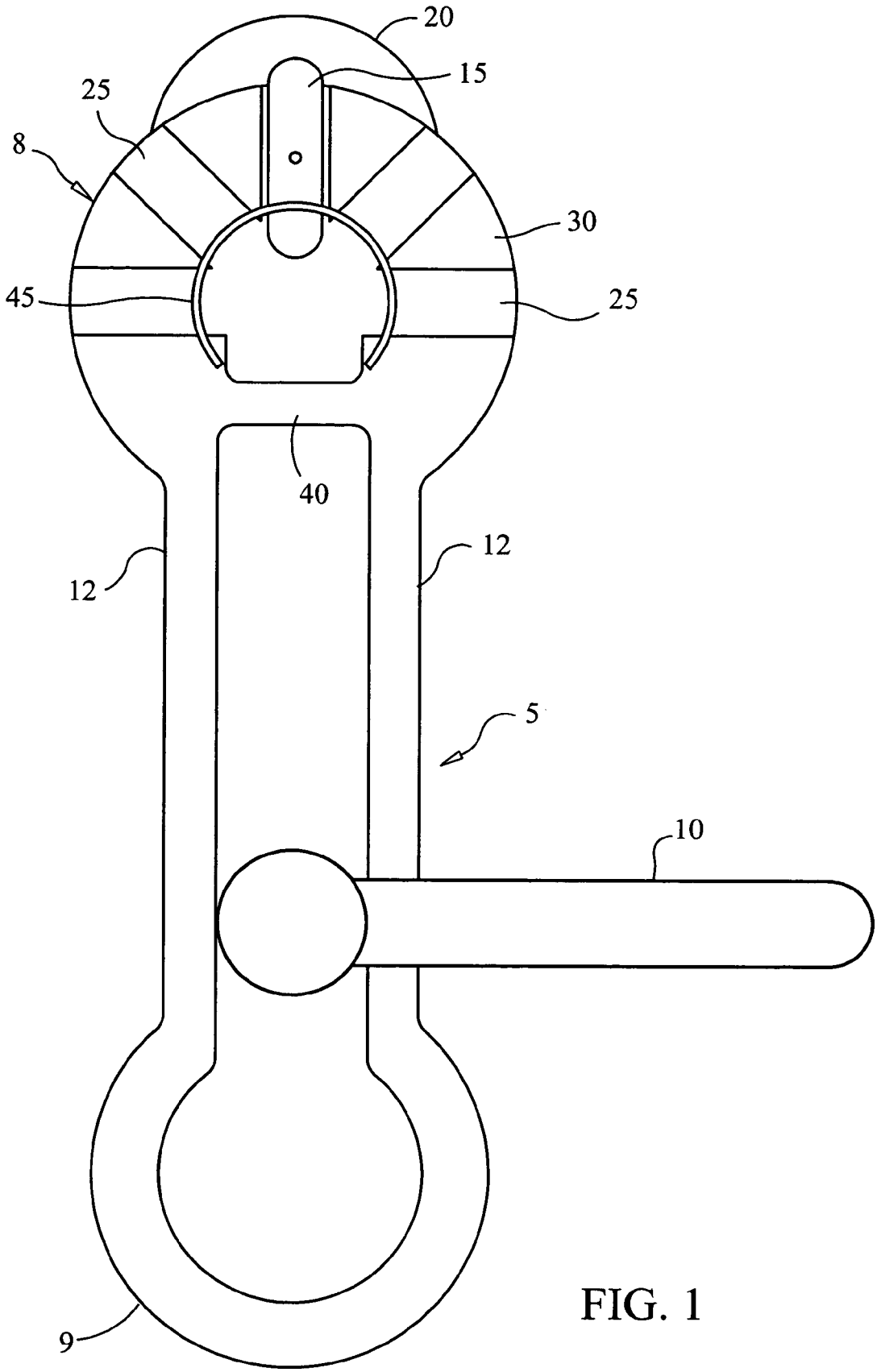
FIG. 1 is a front view of the device with the door handle, deadbolt handle and deadbolt faceplate shown with the door not shown.
Figure 4:
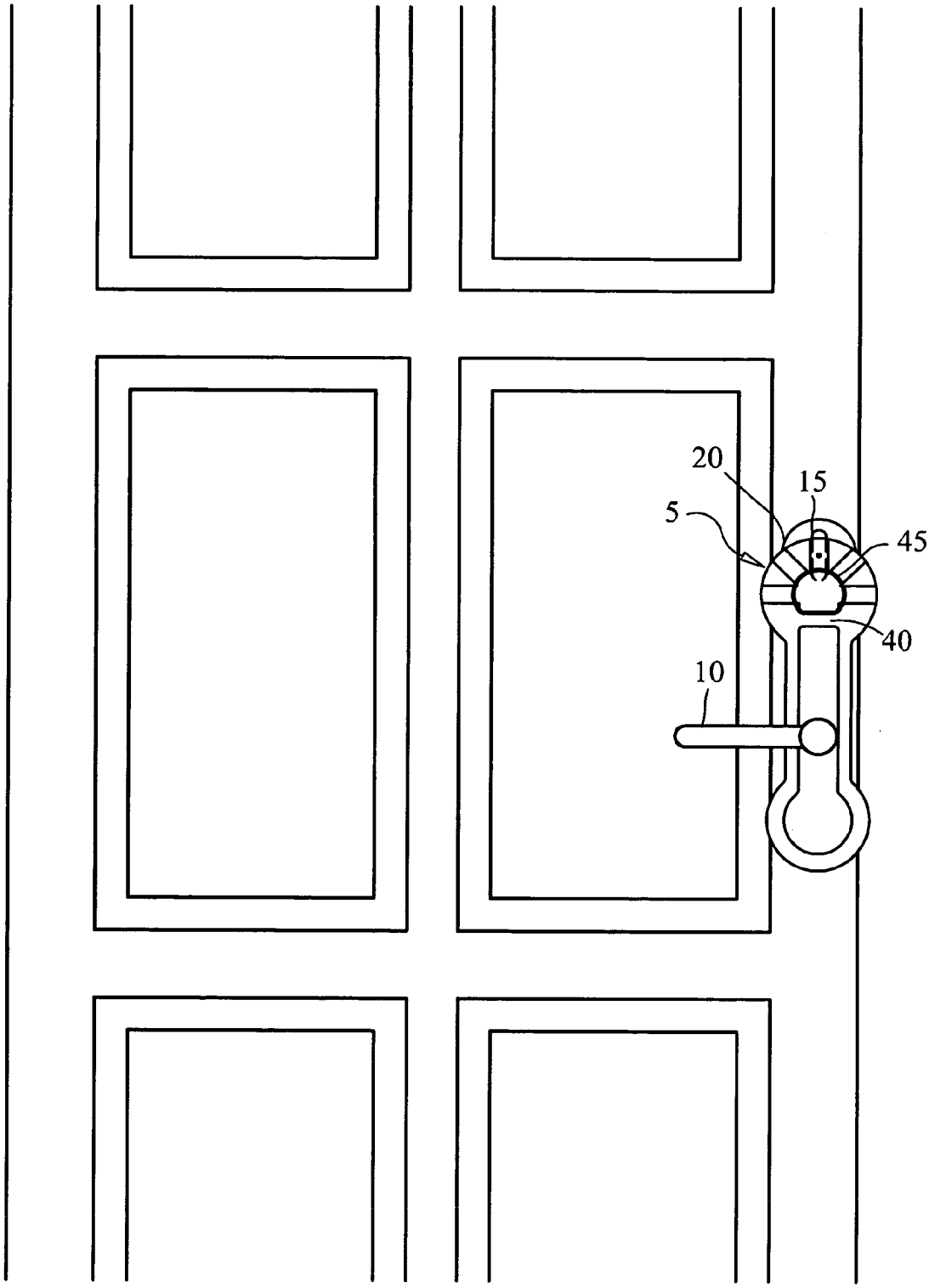
FIG. 4 is a view of the device installed on a door.

This device is comprised of a top section 8 that surrounds the deadbolt handle 15 of a standard deadbolt and a bottom section 9 that surrounds a door handle 10. FIG. 4 The top portion 8 and bottom portion 9 are essentially circular and are connected to each other by two parallel connecting members 12, which join the two circular portions of this device. FIG. 1 The space between the two connecting members is hollow to allow the device to slip over the door handle 10 and dead bolt handle 15. FIG. 4

The top section 8 is flat and circular with a hole in the center of the top section, which has an outer perimeter and an inner perimeter. FIG. 1 Openings are provided along the edges of the inner and outer perimeter through which the deadbolt handle will be inserted. The deadbolt handle 15 fits within a series of channels 25, which are created by a series of raised surface 30 on the top portion of this device. The raised surfaces are of a predetermined height and extend from the inner to the outer perimeter of the top portion. The channels are wide enough to allow the deadbolt handle 15 to be inserted into the respective channel as needed. Although the device is flat with a series of indentations 25, it allows the deadbolt handle 15 to fit within the indentations or channels 25 when it is installed. FIGS. 1, 4

The indentations or channels 25, which are provided, are large enough to allow the deadbolt handle 15 to be inserted within the respective indentation or channel and allow the deadbolt handle 15 to be surrounded by enough of the surface of the raised surfaces 30 to prevent the deadbolt handle 15 from turning the required amount of degrees to open the door when a key in inserted into the key mechanism on the outside.

The top portion would be installed such that it would fit between the faceplate 20 of the deadbolt and the back surface of the deadbolt handle 15. FIGS. 1, 4 This would allow easy installation of this device and simplicity of use. No modification to the door assembly or to the deadbolt or lock of the door would be required.

Figure 2:
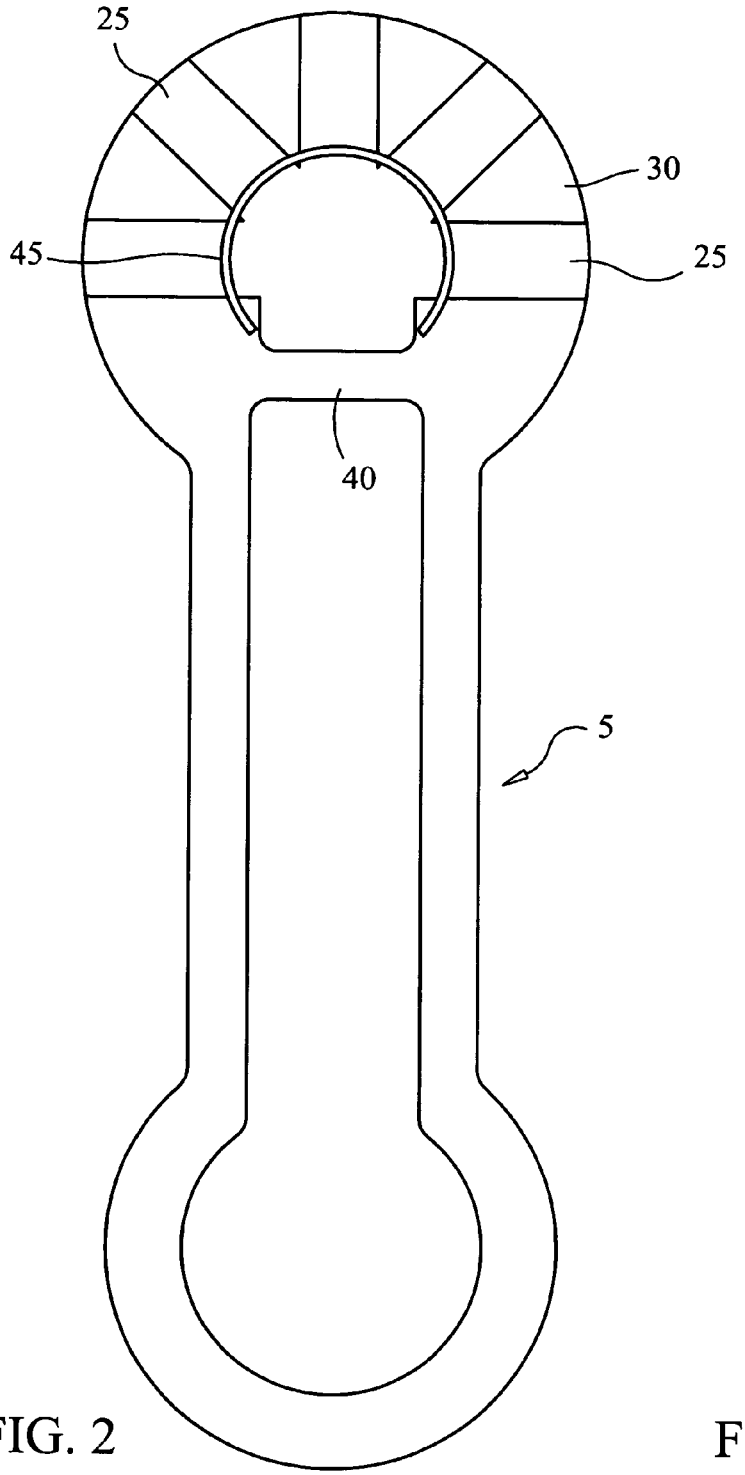
FIG. 2 is a front view of the device without the deadbolt faceplate or door.
Figure 3:
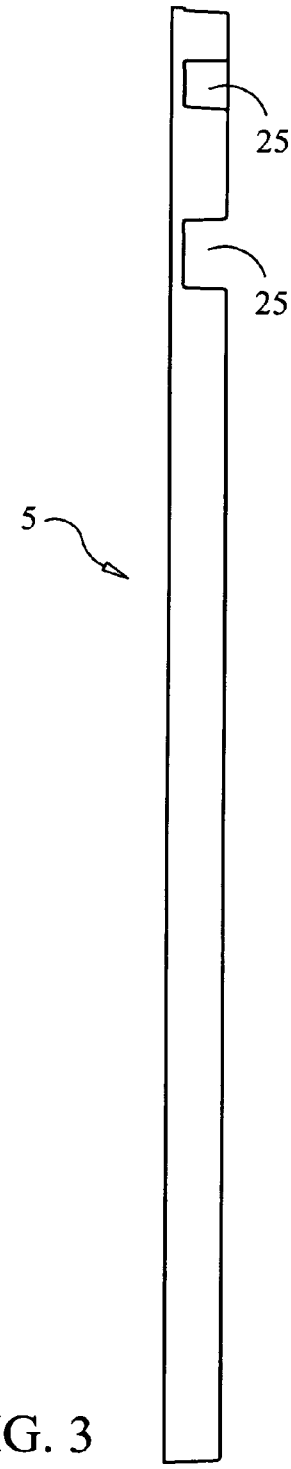
FIG. 3 is a side view of the device.
Figure 5:
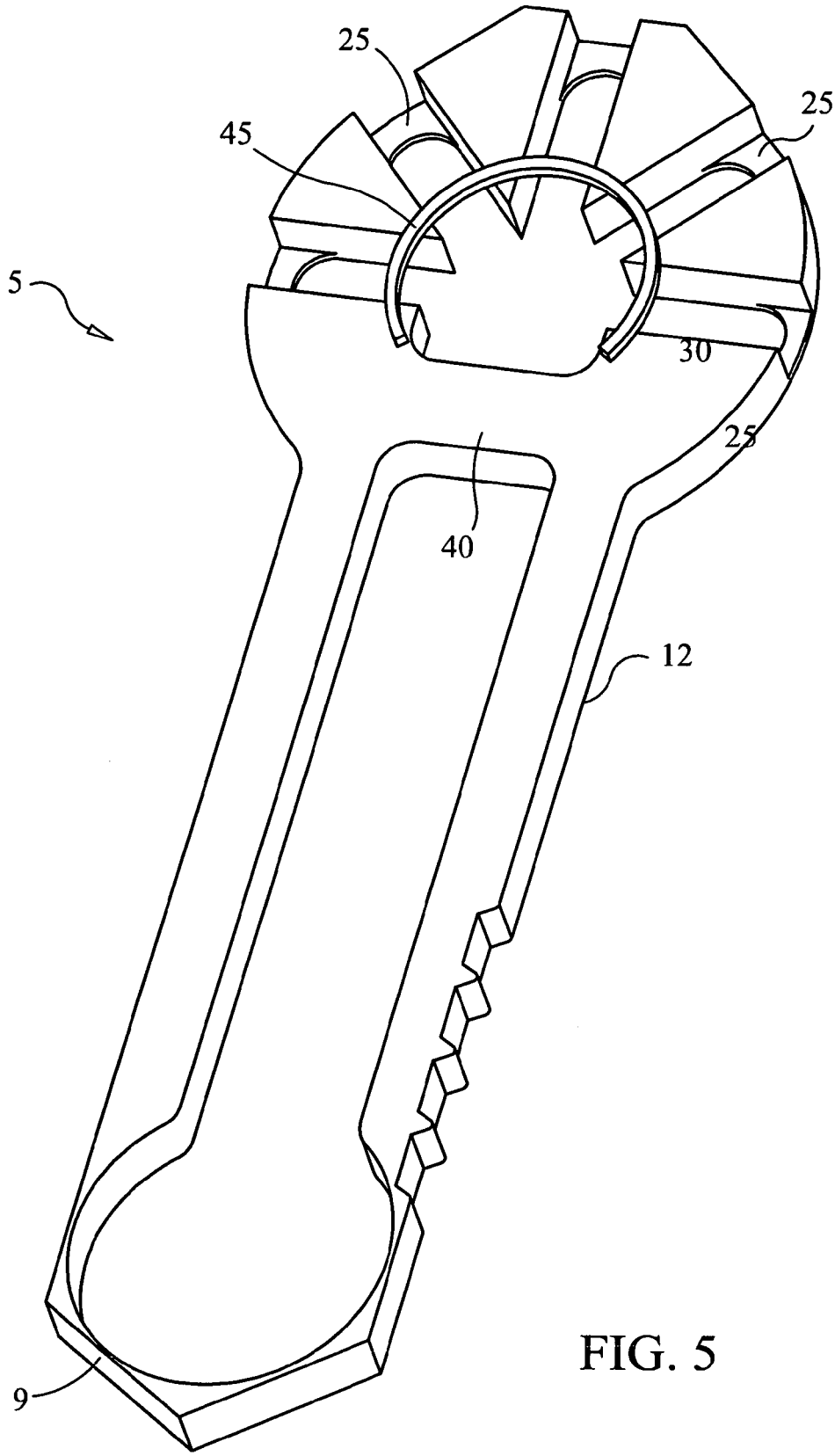
FIG. 5 is an isometric view of the device.

A horizontal support member 40 is installed on the bottom portion of the top portion and connects a pair of connecting members 12. This horizontal member provides additional strength to the top portion. Additionally a retaining ring 45 is inserted around the inner perimeter on the top surface of the raised surfaces to provide additional strength to better insure that the device remains installed as anticipated. FIGS. 2,5

Two connecting members 12 connect the top portion 8 of this device 5 to a bottom section 9 of this device 5 and form one integrated piece. These connecting members 12 are aligned essentially parallel to each other. The bottom portion 9 when the device 5 is installed surrounds the door handle 10 on the bottom. The advantage to completely surrounding the door handle 10 is to ensure that the device stays on the door and also gives an added measure of protection to the deadbolt being turned when a key is placed in the deadbolt key entry access. Additionally when it is not in use the device can simply hang from the door and always be available and easily found.

When the device is installed on the door, the top portion is placed over the deadbolt portion of the door and the bottom portion is placed over the door handle. The deadbolt handle 15 is inserted into one of the channels 25 of the top portion and a portion of the retaining ring would rest above a portion of the deadbolt handle. A portion of the deadbolt handle would extend above the level of the outer perimeter. The device 5 would rest between the deadbolt faceplate 20 and the deadbolt 15.

This device 5 is designed to be lightweight and the choice of material may include plastic, rubber, or a variety of other materials.

While the embodiments of the invention have been disclosed, certain modifications may be made by those skilled in the art to modify the invention without departing from the spirit of the invention.

The inventor claims:

1. A dead bolt security device, which is comprised of:

a. top portion;

wherein the top portion is substantially circular;

said top portion has a back surface of predetermined thickness;

wherein the top portion has an outer perimeter;

wherein openings are provided at predetermined intervals along the outer perimeter;

wherein the top portion has an inner perimeter;

wherein openings are provided at predetermined intervals along the inner perimeter;

b. bottom portion;

wherein the bottom portion is substantially circular;

wherein the bottom portion is closed;

c. connecting members;

said connecting members have a first end and a second end;

said first end is located near the top portion of the connecting member;

wherein the connecting members connect the top portion and the bottom portion;

wherein the area formed by the connecting members between the top portion and the bottom portion is hollow;

wherein the connecting members are of a predetermined width;

wherein the connecting members are of a predetermined thickness;

d. raised surfaces;

wherein a plurality of raised surfaces are positioned on the back surface of the top portion;

said raised surfaces are positioned between the inner perimeter and the outer perimeter of the top portion;

said raised surfaces have a predetermined height;

wherein the raised surfaces form channels in the top portion;

said channels extend from the inner perimeter to the outer perimeter;

wherein said openings around the outer perimeter of the top portion between said plurality of raised surfaces in the top portion are provided;

e. horizontal support member;

said horizontal member is placed between the connecting members near the top portion;

said horizontal member is secured to the first end of the respective connecting members;

g. retaining ring;

wherein said a retaining ring is secured to a portion of the raised surfaces;

said retaining ring is positioned on the top surface of the inner perimeter of the raised surfaces.

2. The dead bolt security device as described in claim 1 wherein the raised surfaces are placed at various angles relative to the center of the top portion.

* * * * *